US005700200A

United States Patent [19]

Su

[11] Patent Number: 5,700,200

[45] Date of Patent: Dec. 23, 1997

[54] SAFETY PLAYING WHEEL MEANS

[76] Inventor: Shan-Nan Su, 26, Lane 143, Hsin-Sheng S. Rd., Sec. 1, Taipei (106), Taiwan

[21] Appl. No.: 734,752

[22] Filed: Oct. 21, 1996

[51] Int. Cl.[6] ..... A63G 1/12

[52] U.S. Cl. ..... 472/26; 472/14

[58] Field of Search ..... 472/14, 25, 26, 472/137; 482/146, 147, 35

[56] References Cited

U.S. PATENT DOCUMENTS 4,076,235 2/1978 Risberg, Jr. ..... 472/26

4,289,306 9/1981 Thomas ..... 472/26

4,620,700 11/1986 Snarr ..... 472/14

5,118,094 6/1992 Lambert ..... 472/14

*Primary Examiner*—Kien T. Nguyen

[57] ABSTRACT

A playing wheel rotatably secured on a base fixed on a fixture of a playground includes a solid spoke portion diverging radially outwardly from a central hub portion of the playing wheel and a plurality of finger slots cut out in a periphery portion of the wheel adjacent to an outermost rim portion of the wheel to prevent injury to a child's fingers or hand as protected by the solid spoke portion of the wheel by eliminating the big openings easily entrapping a child's hand as formed in the spoke portion of a conventional playing wheel.

2 Claims, 3 Drawing Sheets

FIG. 4
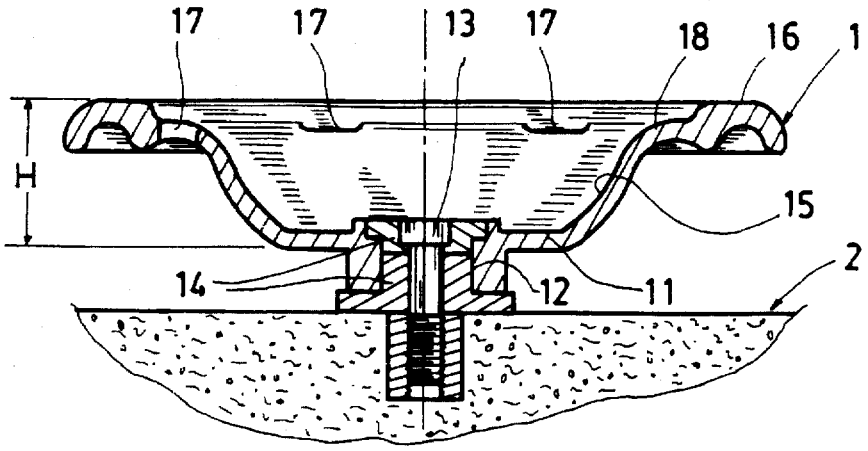
FIG. 5
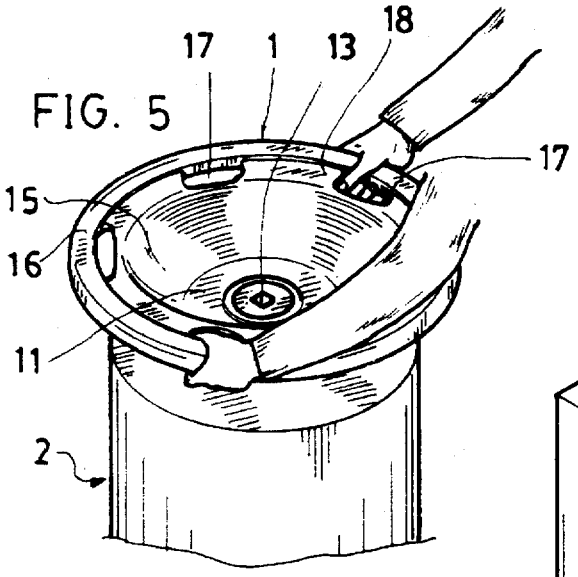
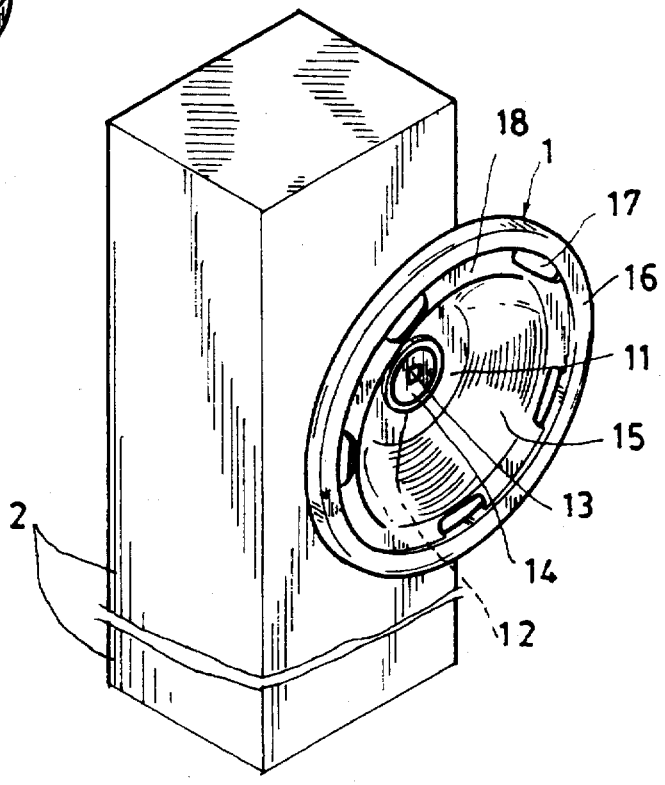
FIG. 6

SAFETY PLAYING WHEEL MEANS

BACKGROUND OF THE INVENTION

A conventional playing wheel W as shown in FIG. 1 includes a flat wheel W having spokes S and an outer rim R secured to the outer portion of the spokes S, and a base B for rotatably mounting the wheel W on the base B by an axle A or shaft. The base B may be secured on a fixture or a building in a playground. Since the flat wheel W is horizontally separated from the base B with a narrow aperture P, a child fingers or hand when rotating the wheel W may be injured as squeezed in the aperture P between the flat wheel W and the base B.

Even though the spoke S of the playing wheel W may be curved upwardly or outwardly as shown in FIG. 2, the big opening O between every two neighboring spokes S may injure a child's hand or fingers when inserting in the opening O during the rotation of the wheel S.

The present inventor has found the drawbacks of the conventional playing wheels and invented the present safety playing wheel means.

SUMMARY OF THE INVENTION

The object of the present invention is to provide a playing wheel rotatably secured on a base fixed on a fixture of a playground having a solid spoke portion diverging radially outwardly from a central hub portion of the playing wheel and a plurality of finger slots cut out in a periphery portion of the wheel adjacent to an outermost rim portion of the wheel to prevent injury to a child's fingers or hand as protected by the solid spoke portion of the wheel by eliminating the big openings easily entrapping a child's hand as formed in the spoke portion of a conventional playing wheel.

BRIEF DESCRIPTION OF THE DRAWINGS

FIG. 4 is a partial sectional drawing of the present invention.

FIG. 5 is an illustration showing a rotation of the playing wheel of the present invention.

FIG. 6 is an illustration of the playing wheel of the present invention when vertically erected.

DETAILED DESCRIPTION

Figure 1:
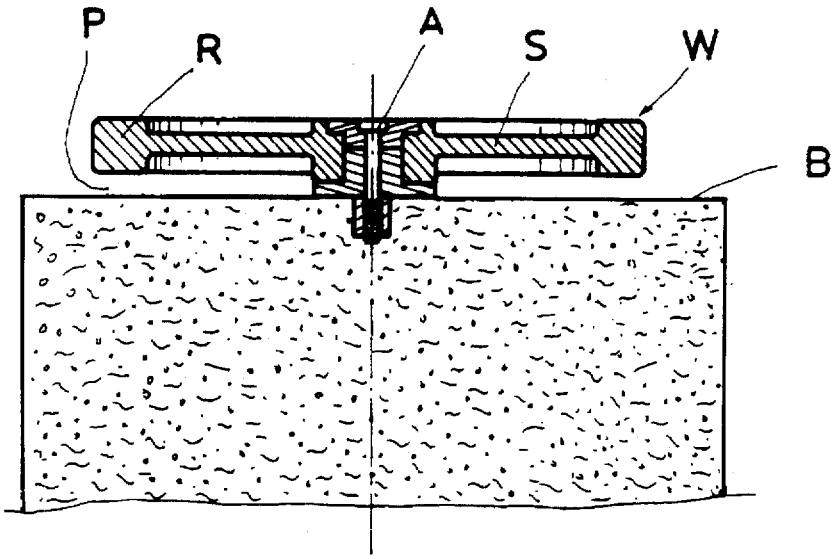
FIG. 1 PRIOR ART
FIG. 1 is a sectional drawing showing a conventional flat playing wheel.
Figure 2:
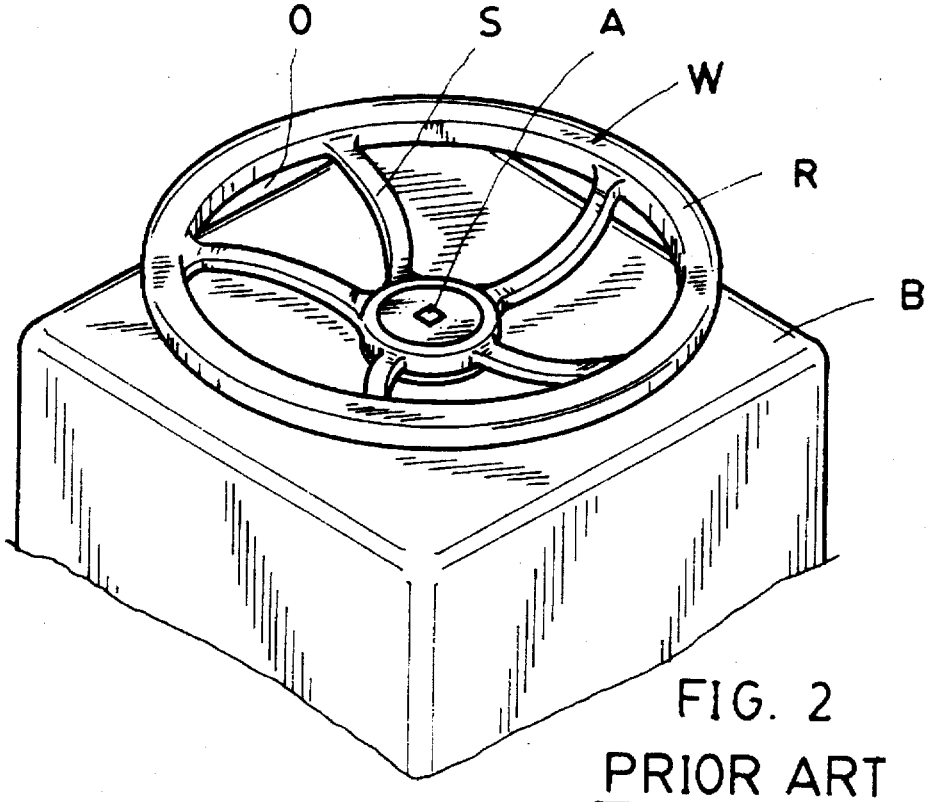
FIG. 2 PRIOR ART
FIG. 2 is a perspective view of a conventional playing wheel having upwardly curved spokes.
Figures 3, 3A:
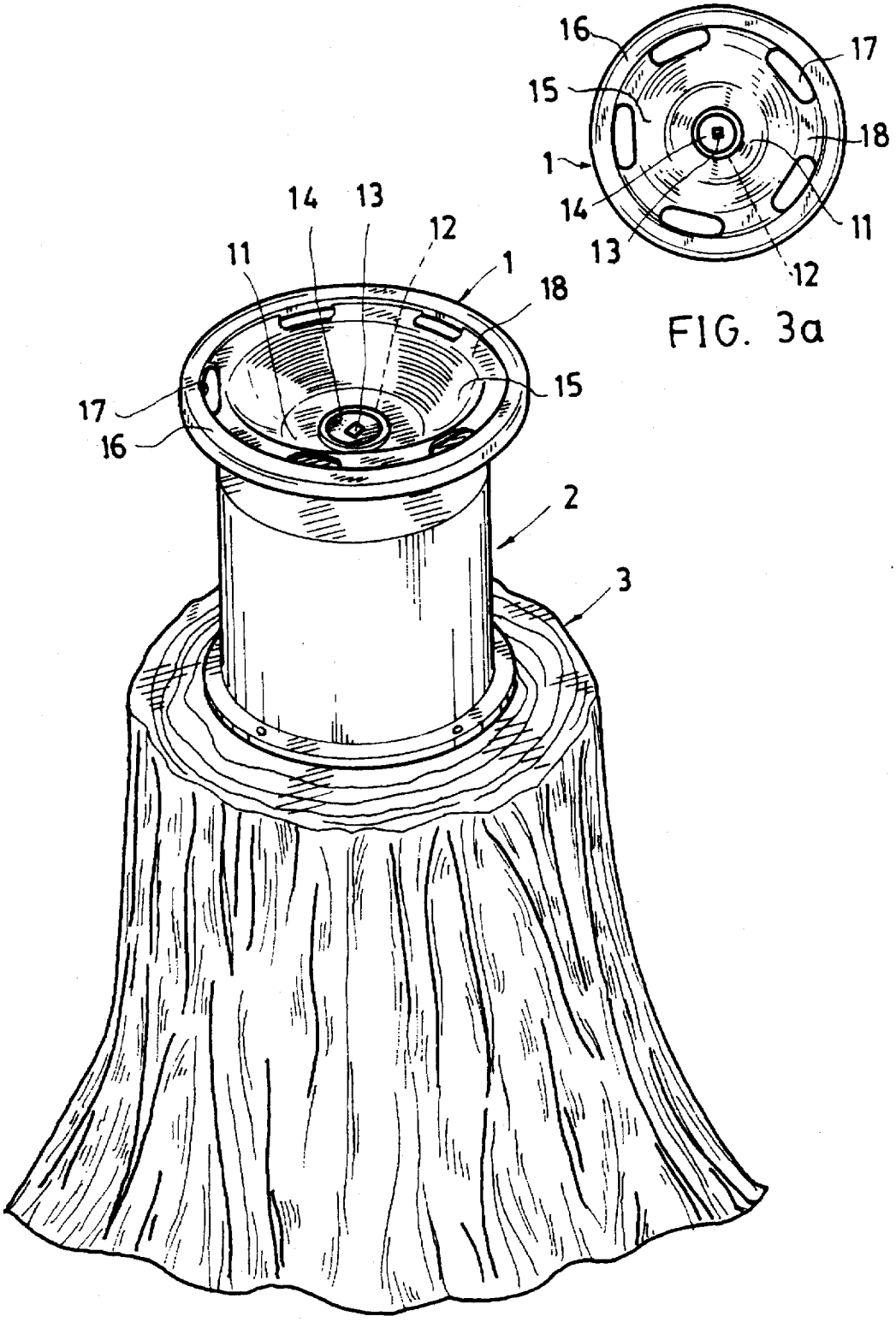
FIG. 3 is a perspective view of the present invention.
FIG. 3*a* is a top view of the present invention as shown in FIG. 3.

As shown in FIGS. 3–5, a preferred embodiment of the playing wheel means of the present invention comprises: a playing wheel 1 rotatably mounted on a base 2 which may be a wooden, a concrete or a metallic base fixed on a fixture 3, a foundation, a platform, or a building of a play ground or park especially adapted for the playing by the children. The wheel 1 may be made by steel, metal, or other materials, not limited in the present invention.

The playing wheel 1 includes: a central hub portion 11 having a shaft hole 12 formed through a central portion of the central hub portion 11, a shaft 13 secured in the base 2 having a bushing or bearing 14 disposed around the shaft 13 and rotatably engageable with the shaft hole 12, a solid spoke portion 15 diverging radially outwardly from the central hub portion 11 having a spoke periphery portion 18 annularly disposed on outer periphery of the spoke portion 15, a plurality of finger slots 17 intermittently formed through the spoke periphery portion 18 each finger slot 17 being adapted for the insertion of a child's fingers including the index, middle, ring and little fingers, and an outermost rim portion 16 circumferentially formed on an outermost periphery of the wheel 1 adjacent to the spoke periphery portion 18 adapted for the grasping of a child's hand as shown in FIG. 5.

The rim portion 16 is separated from the central hub portion 11 at a height H larger than a child's fist when grasping the rim portion 16 of the wheel 1 to prevent injury to the child's hand when rotating the wheel 1.

When a child's hands hold the rim portion 16 of the playing wheel 1 as shown in FIG. 5 by inserting the four fingers of each hand into each finger slot 17 and by grasping the rim portion 16 by the thumb and the four fingers of each player's hand, the wheel 1 can then be rotated for playing purpose. Since the spoke portion 15 is made as solid (not hollow portion), it will preclude insertion of the child's hand and prevent injury to the child. Meanwhile, the rim portion 16 and spoke portion 15 are diverged radially outwardly to separate from the bottom portion (the hub portion) 11 with a height H to prevent squeezing of a child's hand between the wheel 1 and the base 1, thereby enhancing a player's safety when operating the present invention at a play ground.

The playing wheel 1 may be vertically rotatably mounted on a base 1 about a horizontal shaft 13 perpendicularly secured to the base 2 as shown in FIG. 6.

The present invention may be modified without departing from the spirit and scope of the present invention.

I claim:

1. A playing wheel means comprising:

a playing wheel rotatably mounted on a base secured on a fixture in a playground; said playing wheel including a central hub portion rotatably mounted on the base by a shaft fixed in the base, a solid spoke portion diverging radially outwardly from said central hub portion having a spoke periphery portion annularly formed on an outer periphery of said spoke portion, a plurality of finger slots intermittently formed in the spoke periphery portion for inserting the four fingers of index, middle, ring and little fingers of a child's hand into each said finger slot, and an outermost rim portion circumferentially formed on an outermost portion of said wheel adjacent to said spoke periphery portion to be grasped by one thumb and the four fingers of one said child's hand for rotating said wheel for playing.

2. A playing wheel means according to claim 1, wherein said rim portion of said wheel is separated from said central hub portion at a height larger than a child's first when grasping the rim portion by the child's hand including the thumb and the four fingers.

* * * * *